United States Patent [19]

Rich et al.

[11] 4,063,126

[45] Dec. 13, 1977

[54] VACUUM ARC DISCHARGE DEVICE WITH TAPERED ROD ELECTRODES

[75] Inventors: Joseph A. Rich; Willem F. Westendorp, both of Schenectady, N.Y.

[73] Assignee: General Electric Company, Schenectady, N.Y.

[21] Appl. No.: 769,275

[22] Filed: Feb. 16, 1977

[51] Int. Cl.[2] ..... H01J 17/26

[52] U.S. Cl. ..... 313/146; 313/231.4; 313/217; 313/325

[58] Field of Search ..... 313/146, 217, 231.3, 313/231.4, 325

[56] References Cited

U.S. PATENT DOCUMENTS

| | | | |
|---|---|---|---|
| 3,679,474 | 7/1972 | Rich | 313/217 |
| 3,769,538 | 10/1973 | Harris | 313/233 |
| 3,854,068 | 12/1974 | Rich | 313/240 |

*Primary Examiner*—Rudolph V. Rolinec
*Assistant Examiner*—Darwin R. Hostetter
*Attorney, Agent, or Firm*—Marvin Snyder; Joseph T. Cohen; Jerome C. Squillaro

[57] ABSTRACT

In a vacuum arc discharge device of the rod array type, improved arc diffuseness and enhanced ability to hold off voltage during the recovery period are obtained by tapering the rods, with the maximum diameter occurring near the free ends. A higher threshold current for rod anode spot formation and melting also results.

17 Claims, 4 Drawing Figures

VACUUM ARC DISCHARGE DEVICE WITH TAPERED ROD ELECTRODES

INTRODUCTION

This invention relates to vacuum arc discharge devices of the rod array type, and more particularly to such devices wherein the rods are tapered so that the maximum rod diameter occurs near the free ends of the rods.

Vacuum arc discharge devices of the rod array type have long been known, as shown for example, in J. A. Rich U.S. Pat. Nos. 3,679,474, issued July 25, 1972, and 3,854,068, issued Dec. 10, 1974, both of which are assigned to the instant assignee. The rod array structure allows the vacuum arc discharge device to operate at relatively high current levels without formation of anode spots.

In the development of vacuum arc discharge devices, a limiting factor on the amount of current which can be drawn by a given structure is the threshold current at which a destructive anode spot is formed. Anode spots are areas in an anode electrode that deterioriate due to overload current being of excessively high density at these locations. Concentration of overload current in such areas is largely caused by induced magnetic forces present in the interelectrode gap, but is also enhanced when the anode surface area is relatively small or has planes and edges and other types of surface discontinuities at which arcing current can become localized. Formation of anode spots results in erosion and melting on the anode electrodes. This adversely affects the electrode surfaces, lowering the breakdown voltage of the device from its original value and leading eventually to failure of the device. The switch recovery characteristics are also adversely affected by anode spots. This is because erosion of the electrodes leaves irregular surfaces which cause perturbations in the electric field, facilitating a lower breakdown voltage. Additionally, anode spot formation can lead to excessive metal vapor density which prevents the vacuum interrupter from clearing upon occurrence of current zero.

To reduce the problem of anode spot formation, interdigitated arrays of straight cylindrical rod electrodes have been employed in vacuum arc discharge devices. These arrays, in the form of ring-shaped structures of alternating downwardly and upwardly depending rods, provide a plurality of interelectrode gaps, each of which is substantially free of magnetic fields transverse to the path of current conduction between the individual electrode members. Such structure facilitates conduction of high current between adjacent, oppositely-poled electrode members, due to the large electrode area, without bunching of the high currents and consequential formation of destructive anode spots. This conduction occurs with the minimum possible metal vapor density, which is emitted from the cathode rods only in sufficient quantity required to sustain the arc.

We have found, however, that during arcing, though all the straight cylindrical rods are involved in the arcing, the envelope is not filled uniformly with the arc. Only as the arc current amplitude is raised to a sufficiently high level does the arc increasingly fill the envelope. Nevertheless, the arc discharge distribution exhibits a gradient, with maximum electrode current density occurring near the cathode rod ends. If this tendency toward a nonuniform arc discharge can be released, a better-performing vacuum arc discharge device can be obtained. The present invention concerns a device in which such result can be achieved.

Accordingly, one object of the invention is to provide a vacuum arc discharge device of the rod array type in which a substantially uniform or diffuse arc is achieved.

Another object is to provide a vacuum arc discharge device of the rod array type exhibiting a relatively high hold-off voltage.

Another object is to provide a vacuum arc discharge device of the rod array type wherein arc erosion of the rods is relatively uniform over the arcing surfaces thereof.

Briefly, in accordance with a preferred embodiment of the invention, a vacuum arc discharge device comprises a hermetically sealed, evacuated envelope having first and second opposed, conductive end walls. A first plurality of electrically conducting rods contained in the envelope are mechanically and electrically coupled to the first conductive end wall. A second plurality of electrically conducting rods contained in the envelope are mechanically and electrically coupled to the second conductive end wall and interdigitally spaced in alternating fashion with respect to the first plurality of rods. The rods of the first and second pluralities are each tapered along at least the arcing surfaces of the longitudinally overlapped portions of the interdigitated rods, exhibiting an increasing diameter toward the free end and terminating in a substantially hemispherical surface. Means within the envelope coupled to the first conductive end wall are provided for initiating an arc discharge in the vicinity of the rods.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
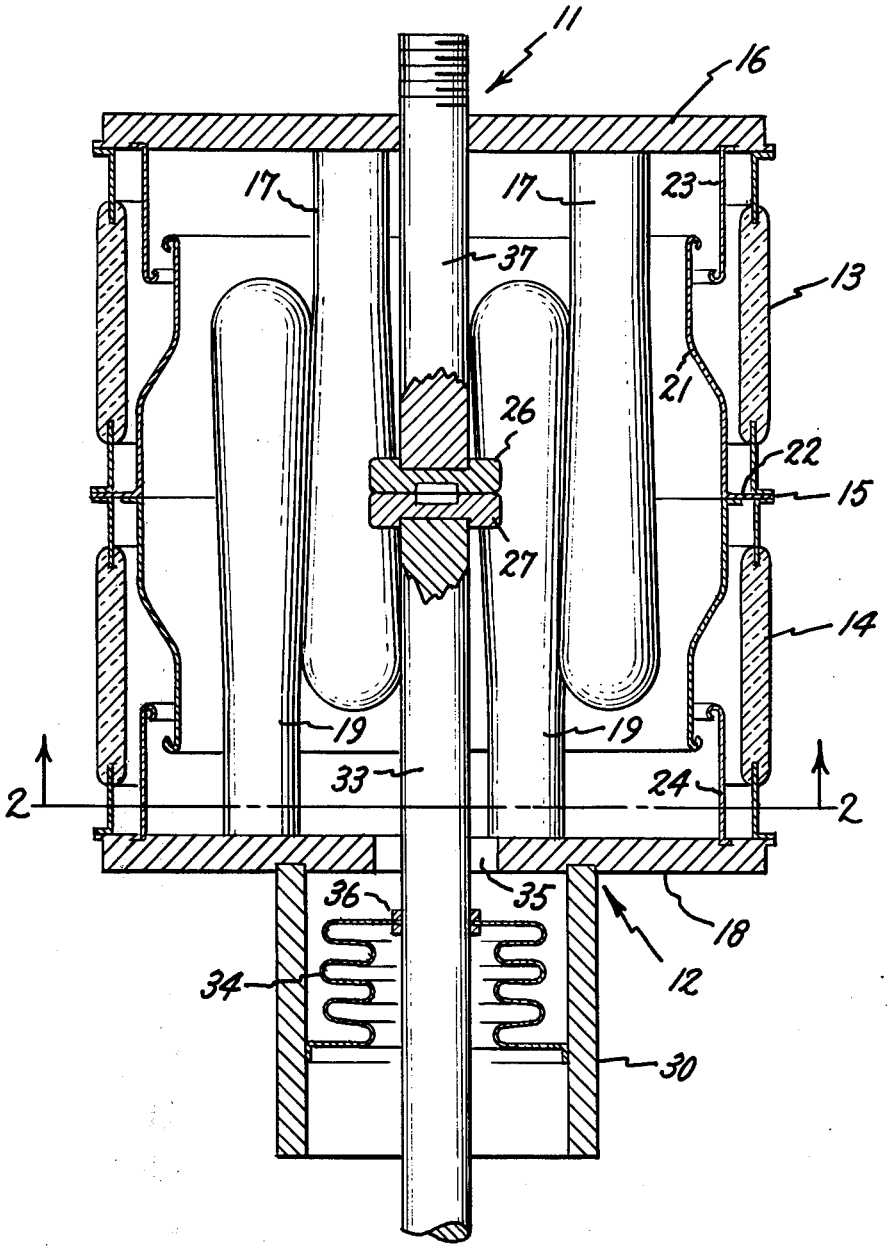
FIG. 1 is a longitudinal, sectional, schematic illustration of a vacuum switch constructed in accordance with the invention.

FIG. 1 illustrates a vacuum switch device constructed in accordance with the present invention. The vacuum switch includes an upper electrode assembly 11 and a lower electrode assembly 12, hermetically sealed to insulating cylindrical side wall members 13 and 14, respectively. Insulating side wall members 13 and 14 are hermetically sealed to each other through a midband assembly 15.

Upper electrode assembly 11 includes a base plate or disk 16 and a plurality of downwardly-depending electrode members 17. Lower electrode assembly 12 includes a plurality of upwardly-depending electrode members 19 and a base plate or disk 18. Each of the individual electrode members 17 and 19 comprises a smooth surfaced, tapered rod having circular walls, with the largest diameter of the circular cross-section being located near the free end of the rod. The free end itself is comprised of a substantially hemispherical surface of radius substantially equal to the radius of the maximum cross-section of the rod, so as to provide the rod with a somewhat bulbous profile. Each of electrode members 17 and 19 is preferably of solid construction but, in the alternative, may be of hollow construction. Electrodes 17 are electrically and mechanically interconnected through conductive disk 16, while electrodes 19 are electrically and mechanically interconnected through conductive disk 18. Rods 17 and 19 may be affixed by any convenient means to base plates 16 and 18, respectively, as by brazing.

Figure 2:
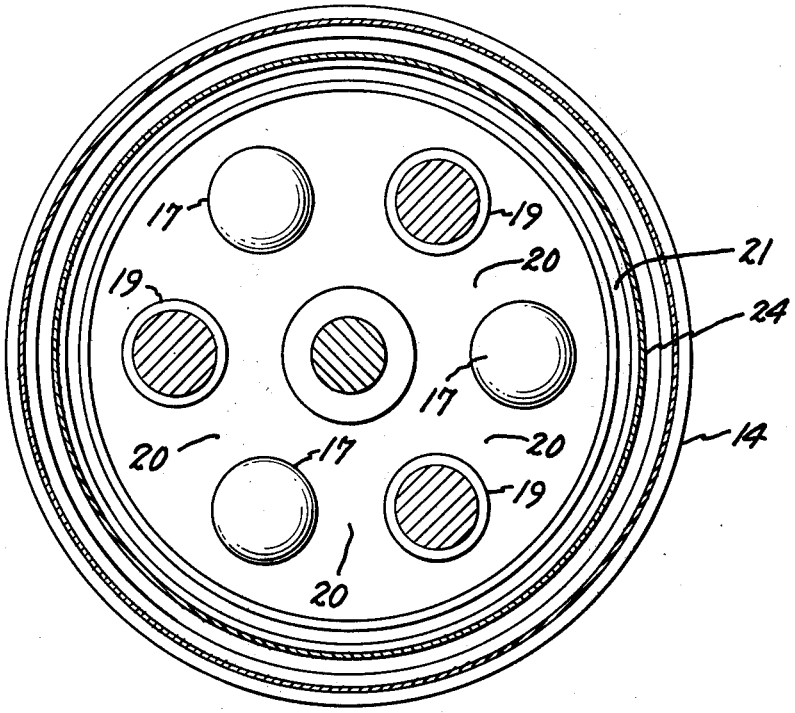
FIG. 2 is a sectional view along line 2—2 of FIG. 1.

The ring-shaped structure defined by the alternation of downwardly-depending electrode members 17 and upwardly-depending electrode members 19 creates a plurality of interelectrode gaps 20, as illustrated in FIG. 2 which is a cross-section of the apparatus of FIG. 1, viewed along line 2—2. The active surfaces of arc electrode members 17 and 19 are at least the portions of the smoothly-curved surfaces thereof which longitudinally overlap each other within the arc discharge device.

The arc electrode materials may be prepared from any vacuum arc electrode material, provided the material is sufficiently gas free. Vacuum-melted 18% nickel steel, such as Vascomax, is a suitable material. Copper, if it is mechanically reinforced as by an internal stainless steel rod, is quite acceptable. This reinforcement is desirable since, after a brazing operation, copper becomes soft and may not have the strength to withstand the large magnetic forces tending to draw the array of rods inward upon themselves during high current operation. The primary constraint on the materials of the rod electrodes is that they must be operative to provide a copious quantity of metallic particles during arcing for supplying conduction carriers during operation of the device.

During operation, it is essential that none of the aforementioned vaporized particles can be deposited on insulating side wall members 13 and 14 separating the opposed electrode assemblies. Accordingly, shield member 21 is provided to surround the arc electrodes. Shield 21 is supported by flange 22 which is afixed, as by welding, to midband assembly 15. Shields 23 and 24, attached to conductive disks 16 and 18, respectively, serve to complete the shielding of the upper and lower portions of sidewall members 13 and 14, respectively. These shield members serve to relieve voltage stresses at the glass-to-metal seals at the upper and lower ends of side wall members 13 and 14, respectively, by grading the electric fields thereat. The shields and end walls 16 and 18 are typically comprised of stainless steel.

Arc-initiating means are provided in the form of massive butt-type arc electrodes 26 and 27, illustrated in FIG. 1 as abutting each other. Electrodes 26 and 27 define a starter arcing gap therebetween, centrally of the ring-shaped array of tapered rod electrodes 17 and 19, when the contacts are parted. Arc electrodes 26 and 27 are sufficiently massive to carry temporarily, without destructive erosion, the currents which are eventually distributed among interelectrode gaps 20 (shown in FIG. 2). Due to the substantially plane-parallel configuration of electrodes 26 and 27, the magnetic forces created by the initial arc struck therebetween, propel the arc almost instantaneously out into the ring array of alternating tapered rods 17 and 19 so as to distribute the discharge uniformly among interelectrode gaps 20.

In the aforementioned Rich U.S. Pat. No. 3,679,474, a vacuum arc discharge device employs straight cylindrical rod electrodes in order to avoid sharp edges or corners on the electrodes upon which arcs may "hang up" and cause formation of anode spots. The objective is to employ the entire surface of each straight cylindrical rod electrode so as to achieve a very broad electrode surface area for carrying arcing current. By avoiding sharp edges or discontinuities, conduction paths are not "bunched" by magnetic forces acting on the plasma, and formation of destructive anode spots is inhibited. Nevertheless, we have observed, in vacuum arc discharge devices employing straight cylindrical rod arrays, that the cathode rod ends play a dominant role in the arc discharge. Although, during arcing, all of the rods are involved in the arcing, the evacuated container is not filled uniformly with the arc. As the arc current level is raised, the envelope becomes increasingly filled with the arc; however, we have found that a gradient exists in the arc discharge distribution, and the maximum electrode current density occurs near the cathode rod ends.

Figure 3:
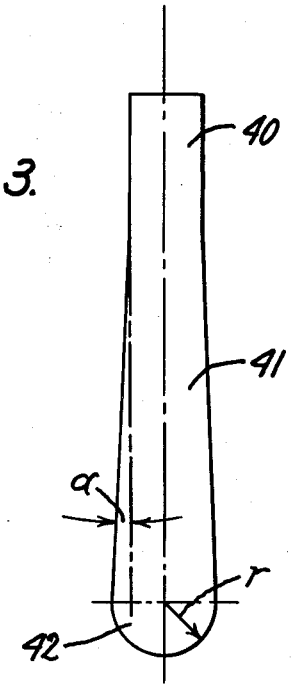
FIG. 3 is a longitudinal, sectional view of a tapered rod electrode employed in the apparatus of the instant invention.

To redress this tendency toward nonuniformity in the discharge when straight cylindrical rod electrodes are employed, particularly at low and moderate currents, we have introduced tapered rod electrodes, the taper being such that the large diameter occurs at the free end of the rod. Preferably, the rod end is terminated in a hemispherical or "ball" end, as shown in FIG. 3. The dominant role previously played by the free end of the cathode rod in straight cylindrical rod arrays is now much diminished since the larger radius of curvature of the cathode rod in tapered rod arrays makes flow of electron current from the free end of the rod less favorable than before. As a result, a better distribution of the arc discharge on the rod electrodes is achieved in comparison to that on straight cylindrical rod arrays. The improved uniformity (i.e., diffuseness) of the arc discharge burning on the rod array electrode structure thereby leads to a higher threshold current for anode spot formation and melting, permitting the device to be employed with higher amplitudes of arcing current. The large radius of curvature at the rod end leads to a dielectric strengthening of the end gap region and an enhanced ability to hold off voltage after current zero.

Our discovery that rod shape constitutes a significant parameter in rod array vacuum arc discharge device design adds a new degree of freedom to the ability to control arc discharge behavior on such structures. That is, by tapering the rods such that the large diameter occurs near the free end of each rod, not only is an improvement in arc diffuseness achieved, but also, during the voltage recovery period after arc extinction, the ability to hold off voltage in the separate gaps formed between the rod ends and the flat base plate of opposite polarity is enhanced. This additional degree of freedom aids in optimizing performance of rod array (diffuse arc) electrode structures in vacuum arc discharge devices.

Establishment of an arc between starter arc electrode members 26 and 27 is accomplished by mounting arc electrode 26 on a fixed conductive rod 37 attached to upper base plate 16, and by mounting arc electrode 27 upon an actuating conductive rod 33 which is allowed to be reciprocally movable by means of a bellows 34. Rods 33 and 37 may typically be comprised of copper, with fixed rod 37 acting as one terminal of the vacuum switch. Bellows 34 is suitably fastened to the outer periphery of an aperture 35 in lower base plate 18 so as to form a hermetic seal therewith, and is similarly fastened by flange 36 to actuating rod 33 so as to form a hermetic seal therewith. The lowermost portion of bellows enclosure 30 may function as the other terminal of the vacuum switch, being electrically connected to rod 33 as by conductive braid (not shown). Starter arc electrodes 26 and 27 may conveniently be constructed of a beryllium-copper alloy containing 7% beryllium by weight, or of a bismuth-copper alloy containing up to ½% of bismuth by weight, or, alternatively, any other of the well-known nonwelding butt contact materials for vacuum arc discharge devices.

To initiate an arc by starter electrodes 26 and 27 alone, a force is applied to actuating arm 33 so as to withdraw electrode 27 from electrode 26, causing an initial arc to be struck therebetween. Electrode 27 is completely withdrawn a sufficient distance from electrode 26 so that as the magnetic forces act upon the struck arc, the arc is preferentially caused to spread out into the spaces between oppositely-poled cylindrical electrode members 17 and 19 and rapidly transfers to the individual gaps 20 shown in FIG. 2.

FIG. 3 illustrates the outline of a typical tapered rod electrode such as electrodes 17 and 19 shown in FIG. 1. The electrode includes a right circular cylindrical portion 40 at the end adapted to be attached to, and supported by, end plates 16 or 18. Beyond right circular cylindrical portion 40, the rod electrode is tapered linearly with distance from the conductive end wall to which it is adapted to be attached, and assumes the shape of a frustum of a cone. Angle $\alpha$, the angly by which the surface of the rod deviates outward from that of a right circular cylinder, may be as large as 4° but is more typically 2° ± 0.5°. Frustum regions 41 of the upwardly and downwardly depending rod electrodes in the rod arrays of a vacuum arc discharge device overlap each other to ensure otimum arc diffusion. The tapered rod electrode is typically terminated in a substantially hemispherical region 42 of radius $r$, which is essentially equal to half the maximum diameter of the tapered rod electrode. Those skilled in the art will recognize that regions 40, 41 and 42 of the tapered rod must blend into each other as smoothly as possible, so as to preclude any pronounced corners or edges which may tend to degrade diffuseness of the arc. Additionally, though the rod electrode of FIG. 3 is illustrated as being of solid configuration, an electrode of hollow configuration would work equally well.

Figure 4:
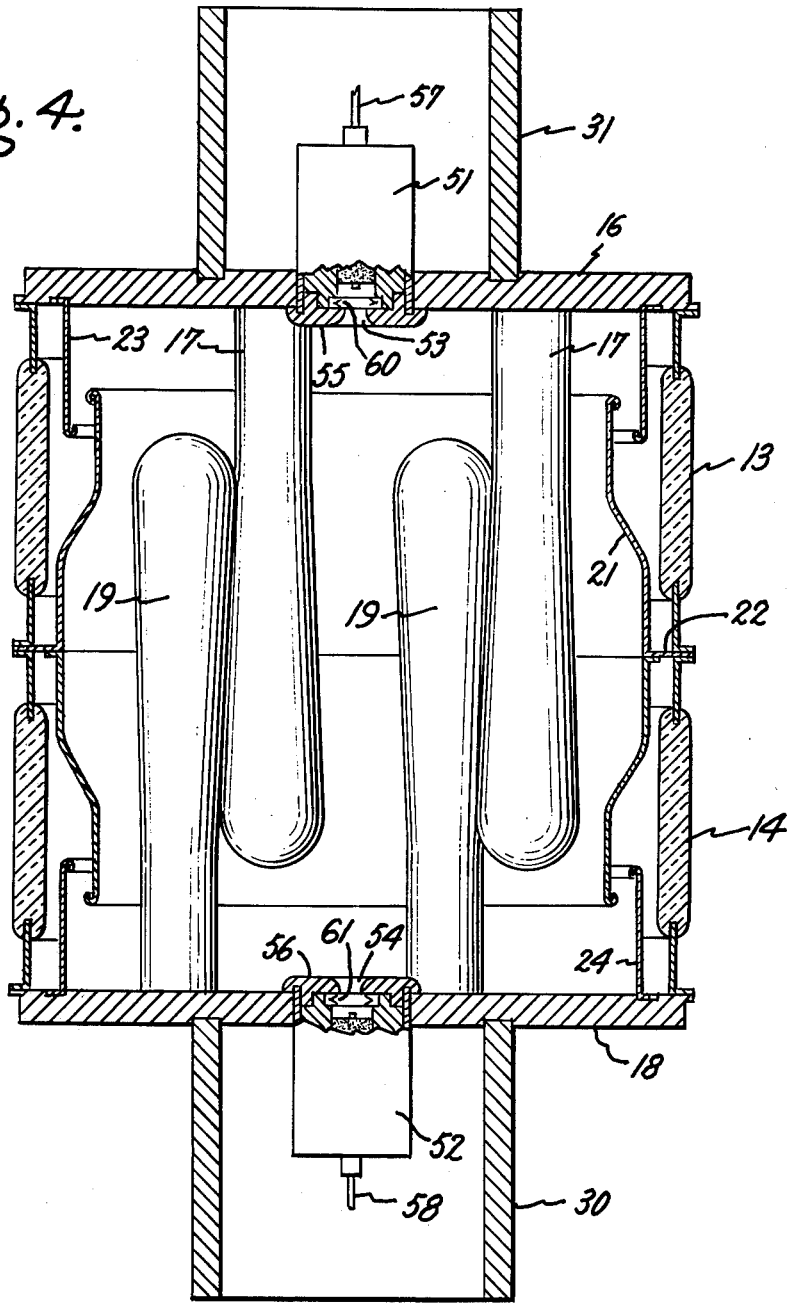
FIG. 4 is a longitudinal, sectional, schematic illustration of a triggered vacuum gap device constructed in accordance with the invention.

FIG. 4 illustrates a triggered vacuum gap device employing tapered rod electrodes. This device is constructed essentially similar to the vacuum switch of FIG. 1, with like reference numbers designating like components, the major difference being that contacts 26 and 27 and their supporting rods, as well as bellows 34, are not employed in the triggered vacuum gap device. Instead, a plasma trigger enclosed in each of cylindrical metallic members 51 and 52 is employed for directing an arc-triggering plasma from annular trigger gap 60 amd 61, respectively, through openings 53 and 54, respectively, in platforms 55 and 56, respectively, into the evacuated interior of the triggered vacuum gap device. The plasma triggers, hermetically sealed to respective end plates 16 and 18, are electrically connected in common by circuit means (not shown) attached to their respective anode leads 57 and 58, so as to ensure that each plasma trigger actuating pulse is applied to both triggers simultaneously. The plasma trigger enclosed in each of cylindrical metallic members 51 and 52 is of the type described in extensive detail in J. M. Lafferty U.S. Pat. No. 3,465,192, issued Sept. 2, 1969 and assigned to the instant assignee, the description of which is incorporated herein by reference. Cylindrical terminals 30 and 31, conveniently fabricated of copper, are attached to end walls 18 and 16, respectively.

In operation, the triggered vacuum gap device of FIG. 4 is nonconductive until an overload current occurs. A voltage pulse produced as a result of an overload current is applied simultaneously to trigger anode leads 57 and 58 with respect to nozzles 55 and 56, respectively, causing vacuum breakdown within one of gaps 60 and 61, respectively, containing the plasma triggers. This results in injection of an electron-ion plasma into the interior of the triggered vacuum gap device. The plasma trigger which fires under these circumstances is the one with its anode lead positive with respect to the end wall to which it is attached. The plasma thus generated immediately triggers an arc between each pair of adjacent tapered rod electrodes 17 and 19, so that the overload current is almost instantaneously short-circuited in the triggered vacuum switch through high current arcs in the interelectrode gaps between adjacent tapered rod electrodes. When the current next falls to zero, the arc is extinguished and is not reignited unless and until an overload current again appears.

In the vacuum arc discharge devices described herein, the arc, being of greater diffuseness than obtainable with conventional cylindrical rod arrays, allows switching of higher currents than previously possible with vacuum arc discharge devices of the same physical size. The hold-off voltage capability of the device is also enhanced by virtue of the relatively large hemispherical surface at the enlarged, free ends of each of the tapered rods.

The foregoing describes a vacuum arc discharge device of the rod array type in which a substantially uniform or diffuse arc is achieved. The device exhibits a relatively high hold-off voltage and undergoes relatively uniform erosion of the rods over the entire arcing surfaces thereof.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

We claim:

1. A vacuum arc discharge device comprising:

a hermetically sealed, evacuated envelope having first and second opposed, conductive end walls;

a first plurality of electrically conducting rods contained in said envelope, each rod of said first plurality being mechanically and electrically coupled to said first conductive end wall;

a second plurality of electrically conducting rods contained in said envelope, each rod of said second plurality being mechanically and electrically coupled to said second conductive end wall, the rods of said second plurality being interdigitally spaced in alternating fashion with respect to said first plurality of rods;

each rod of said first and second pluralities being tapered along at least the arcing surfaces of longitudinally overlapped portions thereof, each rod of said first and second pluralities exhibiting an increasing diameter toward the free end and terminating the substantially hemispherical surface; and means within said envelope coupled to said first conductive end wall for initiating an arc discharge in the vicinity of said rods.

2. The apparatus of claim 1 wherein the rods of said first plurality are arranged in a circular array and the rods of said second plurality are arranged in a circular array.

3. The apparatus of claim 1 wherein the taper of each rod of said first and second pluralities of rods is linear with distance from the conductive end wall coupled thereto.

4. The apparatus of claim 2 wherein the taper of each rod of said first and second pluralities of rods is linear with distance from the conductive end wall coupled thereto.

5. The apparatus of claim 1 wherein said means coupled to said first conductive end wall for intiating an arc discharge comprises a plasma trigger.

6. The apparatus of claim 5 wherein the rods of said first plurality are arranged in a circular array and the rods of said second plurality are arranged in a circular array.

7. The apparatus of claim 5 wherein the taper of each rod of said first and second pluralities of rods is linear with distance from the conductive end wall coupled thereto.

8. The apparatus of claim 6 wherein the taper of each rod of said first and second pluralities of rods is linear with distance from the conductive end wall coupled thereto.

9. The apparatus of claim 1 wherein said means coupled to said first conductive end wall for initiating an arc discharge comprises a movable contact, said apparatus further including a fixed contact electrically coupled to said second end wall and mating with said movable contact when said vacuum arc discharge device is operating within its normal load current limits, said movable contact parting from said fixed contact when a current overload condition occurs.

10. The apparatus of claim 9 wherein the rods of said first plurality are arranged in a circular aray and the rods of said second plurality are arranged in a circular array.

11. The apparatus of claim 9 wherein the taper of each rod of said first and second pluralities of rods is linear with distance from the conductive end wall coupled thereto.

12. The apparatus of claim 10 wherein the taper of each rod of said first and second pluralities of rods is linear with distance from the conductive end wall coupled thereto.

13. The apparatus of claim 1 including means coupled to said second conductive end wall for initiating an arc discharge in the vicinity of said rods.

14. The apparatus of claim 13 wherein each of said means coupled to said first and second end walls for initiating an arc discharge in the vicinity of said rods comprises a plasma trigger.

15. The apparatus of claim 13 wherein each of said means coupled to said first and second end walls for initiating an arc discharge in the vicinity of said rods comprises a butt contact, the butt contacts being separable from each other upon occurrence of an overload current condition.

16. The apparatus of claim 3 wherein the taper of each rod of said first and second pluralities of rods is substantially $2° \pm 0.5°$.

17. The apparatus of claim 4 wherein the taper of each rod of said first and second pluralities of rods is substantially $2° \pm 0.5°$.

* * * * *